US010561205B2

(12) United States Patent
Fildan et al.

(10) Patent No.: US 10,561,205 B2
(45) Date of Patent: Feb. 18, 2020

(54) LINK FOR GARMENT STRAP

(71) Applicants: Gerhard Fildan, Vienna (AT); Karl Wanzenböck, Teesdorf (AT)

(72) Inventors: Gerhard Fildan, Vienna (AT); Karl Wanzenböck, Teesdorf (AT)

(73) Assignee: Dubrosky & Tracy Patent Services Corp., Central (HK)

( * ) Notice: Subject to any disclaimer, the term of this patent is extended or adjusted under 35 U.S.C. 154(b) by 0 days.

(21) Appl. No.: 15/929,057

(22) Filed: Nov. 1, 2018

(65) Prior Publication Data

US 2019/0125034 A1 May 2, 2019

Related U.S. Application Data

(60) Provisional application No. 62/580,054, filed on Nov. 1, 2017, provisional application No. 62/693,529, filed on Jul. 3, 2018.

(51) Int. Cl.

| | |
|---|---|
| ***A44B 11/04*** | (2006.01) |
| ***A41F 1/00*** | (2006.01) |
| ***A44B 11/00*** | (2006.01) |
| ***A41F 15/02*** | (2006.01) |

(52) U.S. Cl.

CPC ..... *A44B 11/04* (2013.01); *A41F 1/00* (2013.01); *A41F 15/02* (2013.01); *A44B 11/006* (2013.01)

(58) Field of Classification Search

CPC . A44B 11/04; A44B 11/06; A41F 1/00; A41F 15/02

See application file for complete search history.

(56) References Cited

U.S. PATENT DOCUMENTS

| | | | | |
|---|---|---|---|---|
| 6,056,625 | A * | 5/2000 | Fildan | A41F 15/002 2/336 |
| 7,107,656 | B2 * | 9/2006 | Chu | A44B 11/04 24/198 |
| 9,115,826 | B2 * | 8/2015 | Wu | H01R 13/60 |
| 9,521,881 | B2 * | 12/2016 | Bachtold | A44B 11/04 |
| 10,046,963 | B2 * | 8/2018 | Smith | B68B 5/02 |
| 10,188,177 | B2 * | 1/2019 | Prugue | A44B 11/18 |
| 2010/0170065 | A1 * | 7/2010 | Paik | A44B 11/04 24/163 R |
| 2018/0055153 | A1 * | 3/2018 | Ressler | A44B 11/04 |
| 2018/0310653 | A1 * | 11/2018 | Martinez | A44B 11/04 |
| 2018/0317612 | A1 * | 11/2018 | Koreishi | A44B 11/04 |

* cited by examiner

*Primary Examiner* — Victor D Batson
*Assistant Examiner* — Matthew J Sullivan
(74) *Attorney, Agent, or Firm* — Kinter IP, LLC; Mary Frances Ludwig

(57) ABSTRACT

A link or slide for a garment strap includes mutually parallel longitudinal bars and a pair of opposing transverse bars each forming a juncture with ends of the longitudinal bars. The transverse bars curve forward from the junctures away from the rear of the longitudinal bars, reducing potential discomfort to an active wearer. In embodiments, the link is formed of resilient material and the link thickness tapers to a minimum at the junctures, forming flexible zones which provide added comfort. In additional embodiments, the longitudinal bars have angled edges adjoining slots through which the garment strap passes. The angled edges resist undesirable motion of the strap, especially while the wearer is exercising.

14 Claims, 7 Drawing Sheets

LINK FOR GARMENT STRAP

CROSS REFERENCE TO RELATED APPLICATIONS

This application claims the filing benefit under 35 U.S.C. § 119(e) of U.S. Provisional Application No. 62/580,054, filed 1 Nov. 2017, and of U.S. Provisional Application No. 62/693,529, filed 3 Jul. 2018, both of which are hereby incorporated by reference.

TECHNICAL FIELD

The present invention pertains generally to garment strap assemblies, and more particularly to a link or slide for a garment strap.

BACKGROUND OF THE INVENTION

Strap assemblies for garments, such as brassieres, lingerie, or swimwear articles, commonly include links for joining the straps to the garment fabric or for adjusting the length of the straps, the latter type of link also referred to herein as a slide. In sports bras or other activewear applications, the straps are often relatively wide to provide support and stability while the wearer of the garment is exercising or otherwise in frequent or strenuous motion. Links for such straps are commonly on the order of 15 mm to 30 mm in width.

The size of prior art links, when coupled with motion of the wearer, often results in uncomfortable conditions, such as edges or corners of the link poking or abrading the skin of the wearer. Often such links comprise steel or other metals which further contributes to discomfort.

Reducing the size of links for activewear may compromise the stability of the garment. For example, thinner slides may inadvertently move when the wearer is in motion, causing a brassiere cup to sag and provide inadequate support to the wearer.

There is therefore a need in the art for improved links and slides which provide greater comfort to an active wearer while also providing security against undesired movement of the slide and other garment components.

BRIEF SUMMARY OF THE INVENTION

The present invention is directed a link for a garment strap which improves comfort especially for an active wearer. The link comprises:

a pair of outer mutually parallel longitudinal bars, each having two opposing ends and rear edges lying in a rear plane;

a pair of opposing transverse bars each forming a juncture with an end of each of the longitudinal bars and defining a slot between the longitudinal bars;

the transverse bars curving forward from the junctures away from the rear plane; and, wherein the link is formed of a resilient material.

The curvature of the transverse bars, coupled with the resilience of the link material, provides a flexible form which reduces the potential for discomfort caused by the link poking into or abrading against the skin of the wearer, especially when the wearer is in motion. The link is well suited for use in sports brassieres, swimwear, or other garments designed for an active wearer.

In accordance with an embodiment of the link, the longitudinal bars have a thickness which tapers to a minimum at the junctures. This feature results in highly flexible zones, providing added comfort to the wearer.

In accordance with another embodiment, the link includes a central bar having two opposing ends, the central bar extending parallel to and spaced between the longitudinal bars, and, the pair of opposing transverse bars each forming a juncture with an end of the central bar and defining respective slots on opposite sides of the central bar. This embodiment of the link may also be referred to as a slide, and is useful for adjusting the length of a garment strap. In accordance with another embodiment, the longitudinal bars and the central bar both have a thickness which tapers to a minimum at the junctures, providing increased flexibility and comfort.

In accordance with another embodiment, the thickness at the junctures is at most 50% of the thickness at the midpoint of the longitudinal bars or the central bar.

In accordance with another embodiment, the longitudinal bars have a forwardmost edge lying in a front plane, and the transverse bars curve forward beyond the front plane.

In accordance with another embodiment, the longitudinal bars have an angled edge adjoining the slot. The angled edge contacts and resists undesirable motion of the strap, especially while the wearer is exercising.

In accordance with another embodiment, the link is formed of polyoxymethylene, polyacrylate, polycarbonate, or polyurethene.

In accordance with another embodiment, a front face of each of the longitudinal bars has a textured surface for improved gripping of the strap. In accordance with another embodiment, a front face of each of the longitudinal bars has a textured surface and a front face of the central bar has a smooth surface.

In accordance with a preferred embodiment of the link, the longitudinal bars having a thickness which tapers to a minimum at the junctures; the longitudinal bars having an angled edge adjoining the slot; and, the link is formed of polyoxymethylene, polyacrylate, polycarbonate, or polyurethene.

In accordance with a preferred embodiment of the slide, the longitudinal bars and the central bar having a thickness which tapers to a minimum at the junctures; the longitudinal bars having an angled edge adjoining the slot; and, the link is formed of polyoxymethylene, polyacrylate, polycarbonate, or polyurethene.

Further provided is a garment including a link according to any one of the embodiments above.

Other embodiments, in addition to the embodiments enumerated above, will become apparent from the following detailed description, taken in conjunction with the accompanying drawings, which illustrate, by way of example, the principles of the link and garments incorporating same.

DETAILED DESCRIPTION OF THE INVENTION

Figure 3:
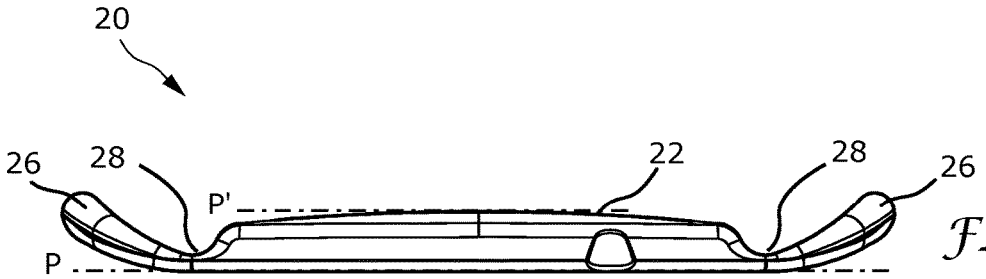
FIG. 3 is a plan view thereof.
Figure 2:
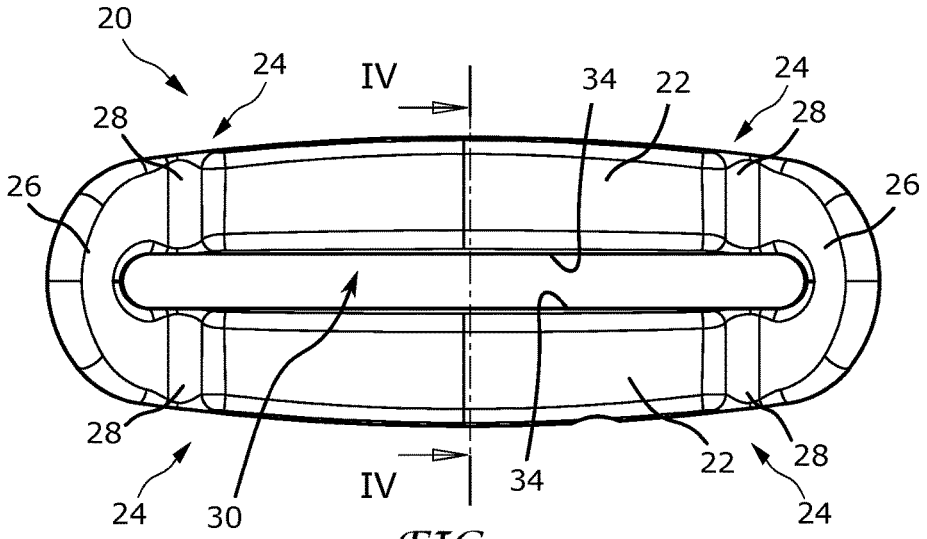
FIG. 2 is a front elevation view thereof.
Figure 1:
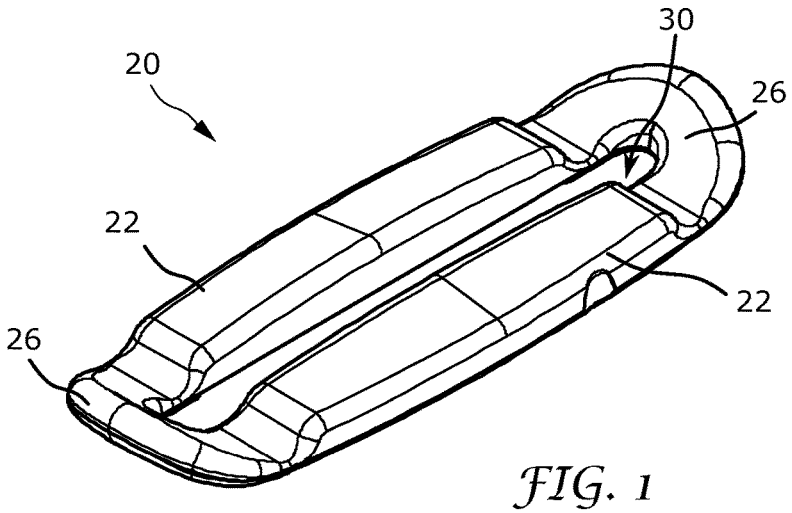
FIG. 1 is a perspective view of a link for a garment strap.

Referring initially to FIGS. 1-4, there are illustrated perspective, front elevation, plan, and enlarged cross-sectional views, respectively, of a link for a garment 70 (see FIG. 10), the link generally designated as 20. Link 20 includes a pair of outer mutually parallel longitudinal bars 22, and each longitudinal bar 22 has two opposing ends 24. Two transverse bars 26 are located on opposing ends of the longitudinal bars, and form junctures 28 with ends 24 of the longitudinal bars. A slot 30 is defined between the longitudinal bars and the transverse bars.

Figure 10:
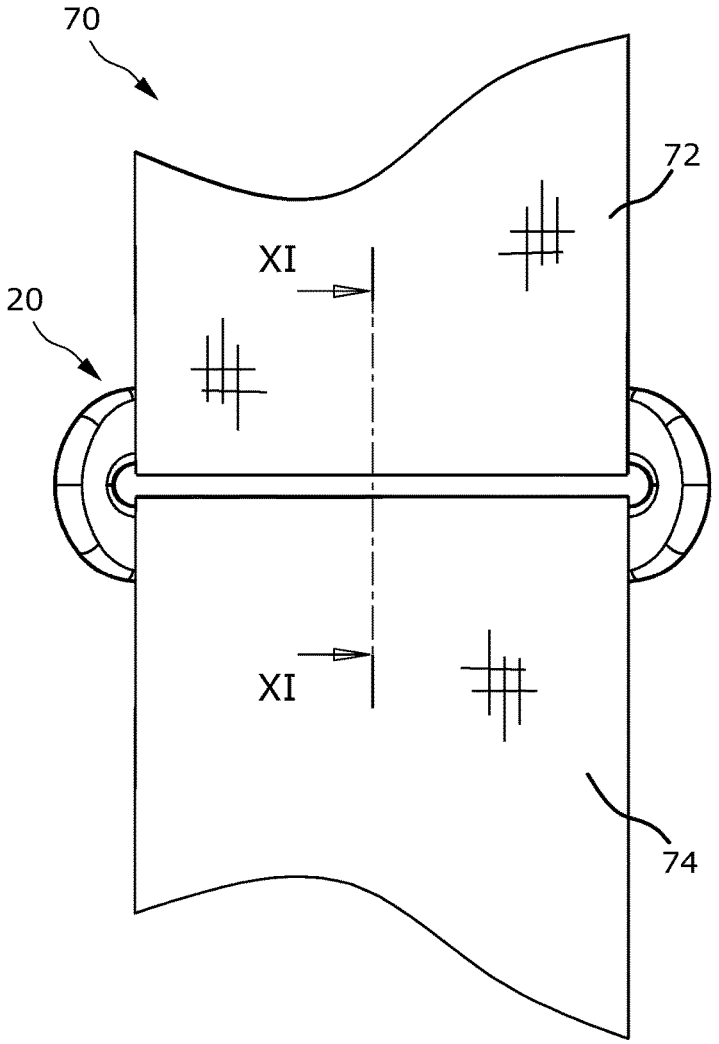
FIG. 10 is a front elevation view of the link with a garment.
Figure 11:
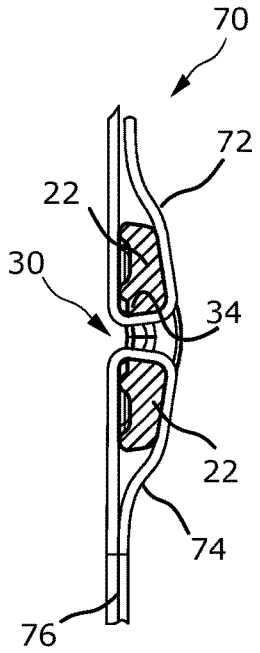
FIG. 11 is a cross-sectional view along line XI-XI of FIG. 10.

FIG. 10 is a front elevation view of link 20 with garment 70 (partially shown), and FIG. 11 is a cross-sectional view along line XI-XI of FIG. 10. Link 20 is used to join two pieces, 72 & 74, of garment 70. Commonly, piece 72 may be a garment strap, which is passed through slot 30 and looped around one longitudinal bar 22, while piece 74, which may be another piece of a strap, the apex of a brassiere cup, or other garment piece, is passed through slot 30 and looped around the other longitudinal bar 22. In FIG. 11, the ends of garment piece 74 are shown at 76 to be welded or stitched together; the ends may also be joined to another piece of garment 70. The ends of garment piece 72 are connected elsewhere on garment 70.

Figure 4:
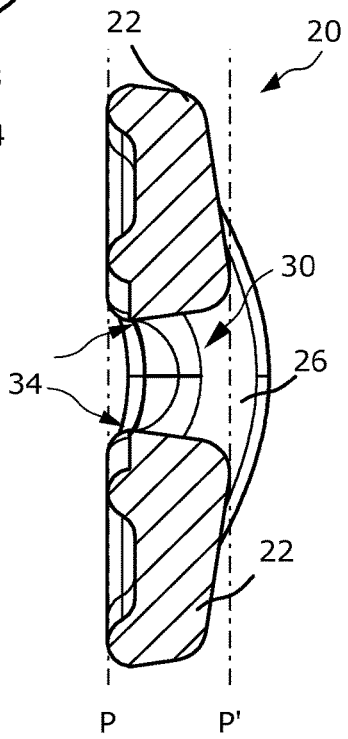
FIG. 4 is an enlarged cross-sectional view along line IV-IV of FIG. 2.

Referring again to FIGS. 2-4, longitudinal bars 22 have rear edges lying in a rear plane, P, and forwardmost edges lying in a front plane, P'. As used herein with respect to the link, the terms 'rear' or 'backward' indicate the direction of the body of the wearer and the terms 'front' or 'forward' indicate the direction away from the body of the wearer, irrespective of whether the link is located on the wearer's front or back. Transverse bars 26 curve forward from junctures 28, away from rear plane P. This forward curvature improves comfort and prevents the ends of link 20 from poking or rubbing against the skin of the wearer, especially when the link is used with activewear. In embodiments, transverse bars 26 curve forward beyond front plane, P', as seen in FIGS. 3 & 4.

FIGS. 5-9 are, respectively, perspective, front elevation, plan, and cross-sectional views of another embodiment of the link. This embodiment, also referred to as a slide 40, is slid along a garment strap to adjust the strap length. Slide 40 includes a central bar 42 which extends parallel to and is spaced between two longitudinal bars 22. Central bar 42 has two opposing ends 44, and opposing transverse bars 26 each form a juncture 28 with an end 44 of central bar 42. Two respective slots 31, 32 on opposite sides of central bar 42 are each defined by central bar 42, one of the longitudinal bars 22, and the two transverse bars 26.

Figure 7:
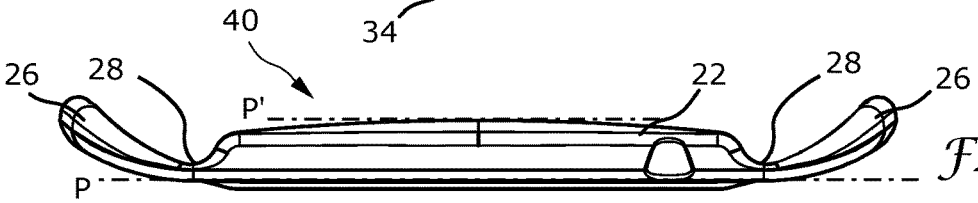
FIG. 7 is a plan view thereof.
Figure 6:
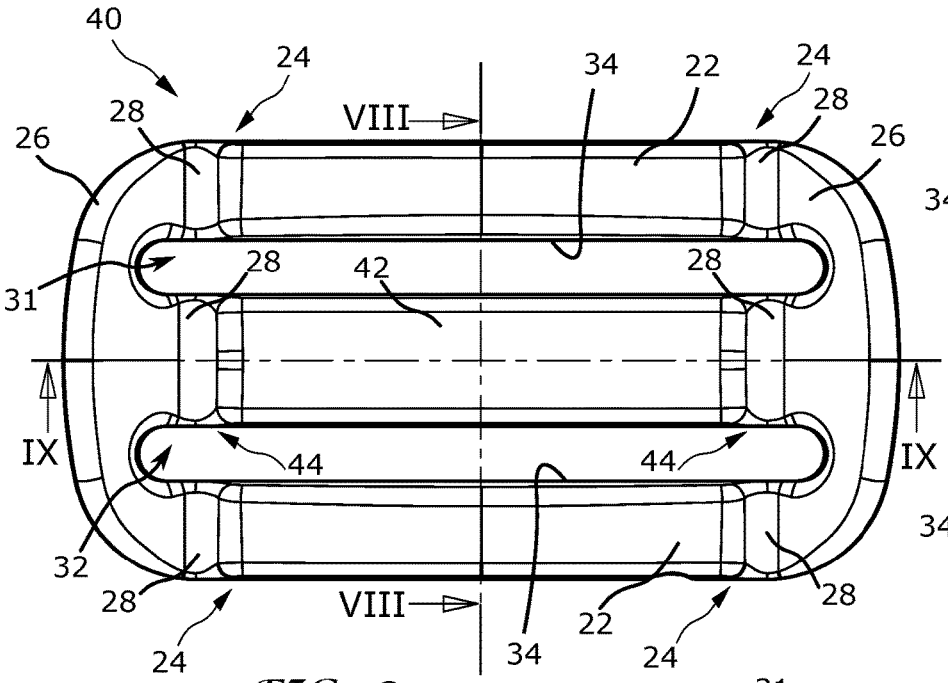
FIG. 6 is a front elevation view thereof.
Figure 8:
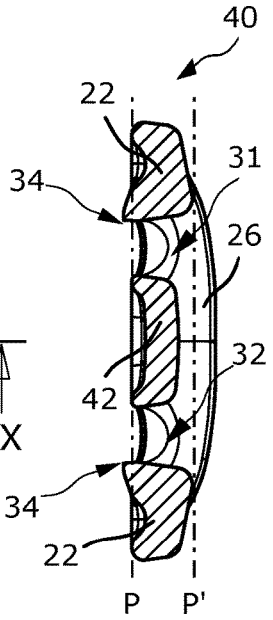
FIG. 8 is a cross-sectional view along line VIII-VIII of FIG. 6.
Figure 5:
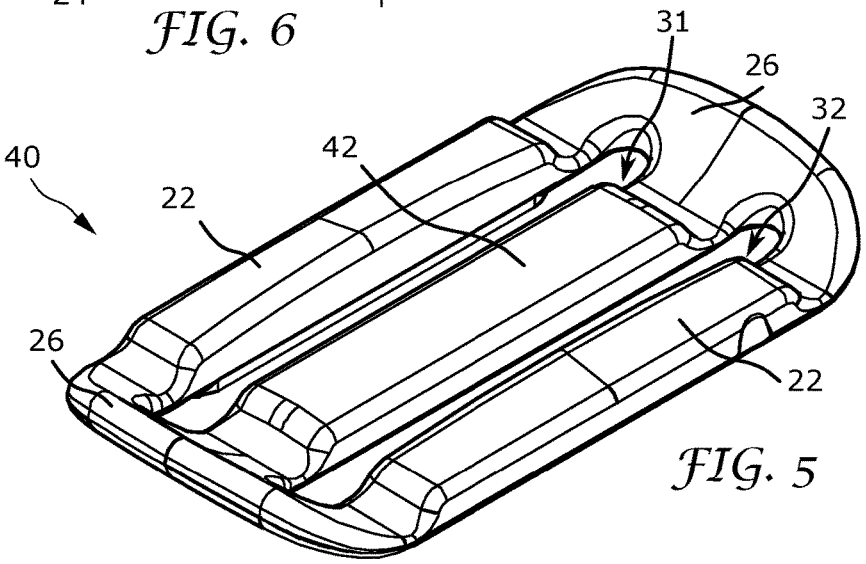
FIG. 5 is a perspective view of another embodiment of the link.

As described above for link 20, longitudinal bars 22 of slide 40 have rear edges lying in a rear plane, P, and forwardmost edges lying in a front plane, P'. Transverse bars 26 curve forward from junctures 28 away from rear plane P. In embodiments, transverse bars 26 curve forward beyond front plane, P', as shown in FIGS. 7 & 8.

Link 20 and slide 40 are formed of a resilient material. In various embodiments, the link or slide may be formed of polyoxymethylene (POM), polyacrylate (e.g. PA66 or PA12), polycarbonate (PC), or polyurethene (PU).

Figure 9:
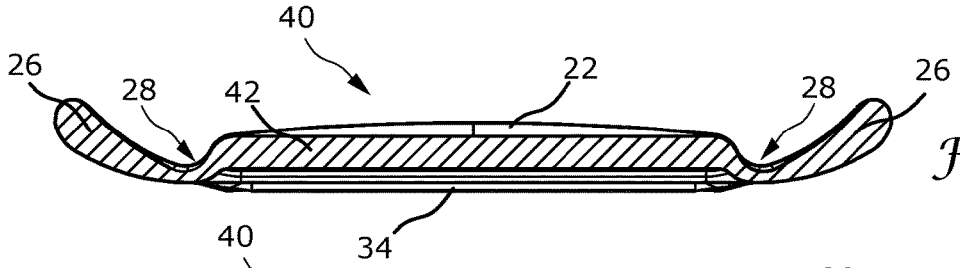
FIG. 9 is a cross-sectional view along line IX-IX of FIG. 6.

Longitudinal bars 22 of link 20 and slide 40 have a thickness measured from the rear surface to the front surface. In embodiments, the thickness of longitudinal bars 22 tapers to a minimum at junctures 28, as shown in FIGS. 3, 7, & 9. In the same embodiments, the thickness of central bar 42, if present, tapers to a minimum at junctures 28. Similarly, in embodiments, the thickness of transverse bars 26, measured from the rear surface to the front surface, tapers to a minimum at juncture 28. The relatively thin structure in the regions of juncture 28, coupled with the resilience of the link material, provides a flexible region which bends under pressure rather than jabbing into the body of the wearer, thereby providing additional comfort to the wearer when in motion.

In embodiments, the width of link 20 and slide 40, as measured between the outer edges of transverse bars 26, is between about 18 mm and about 30 mm. In one exemplary embodiment, the width of the link is 19 mm, the thickness at the junctures is about 0.5 mm, and the thickness at the midpoint of the central bar is about 1 mm.

Figure 12:
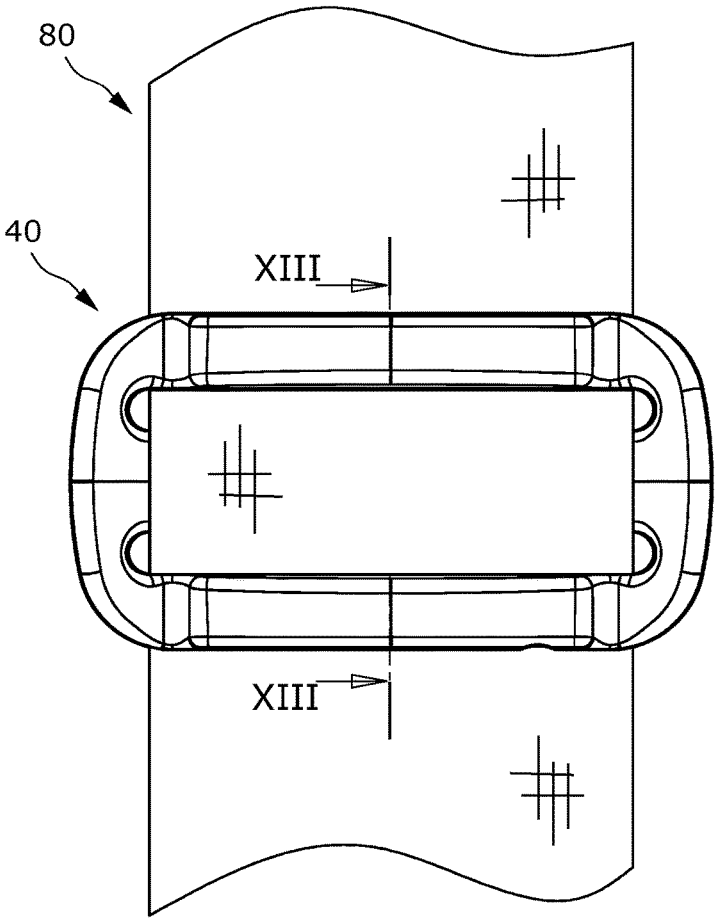
FIG. 12 is a front elevation view of another embodiment of the link with a garment.
Figure 13A:
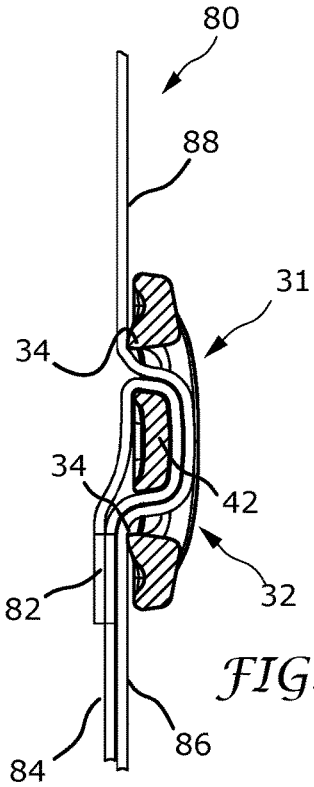
FIGS. 13A & 13B are cross-sectional views along line XIII-XIII of FIG. 12, showing embodiments of the garment.
Figure 13B:
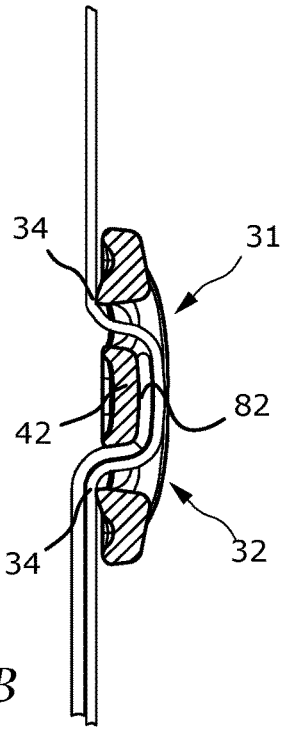
Figure 14:
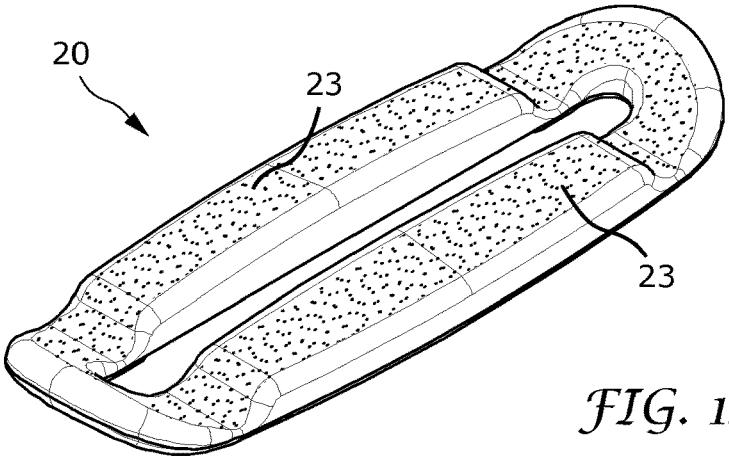
FIG. 14 is a front perspective view of another embodiment of the link for a strap.
Figure 15:
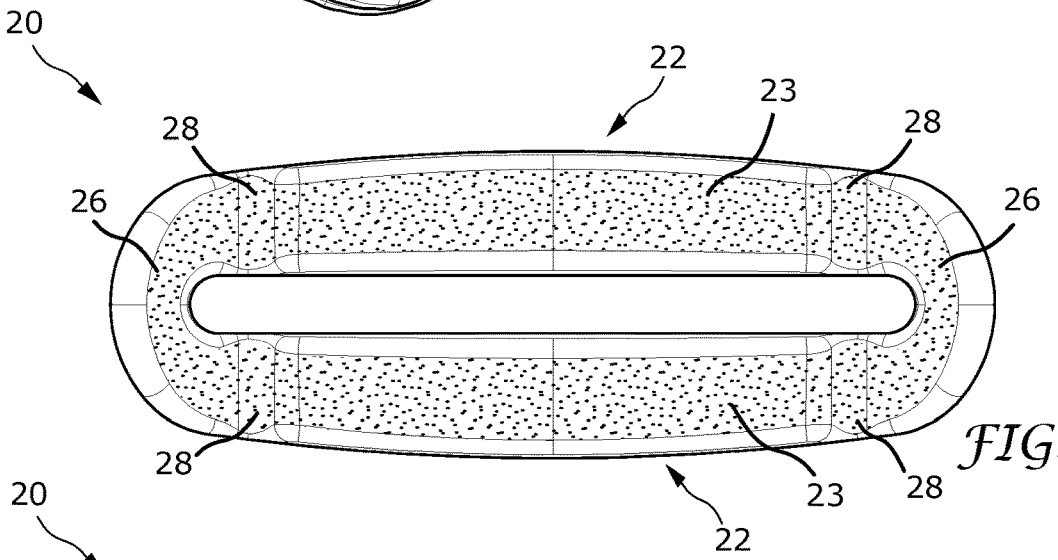
FIG. 15 is a front elevation view of the FIG. 14 embodiment.
Figure 16:
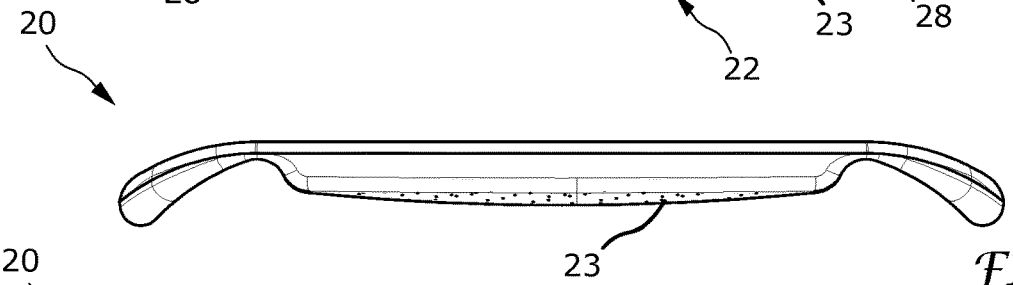
FIG. 16 is a top plan view of the FIG. 14 embodiment.
Figure 17:
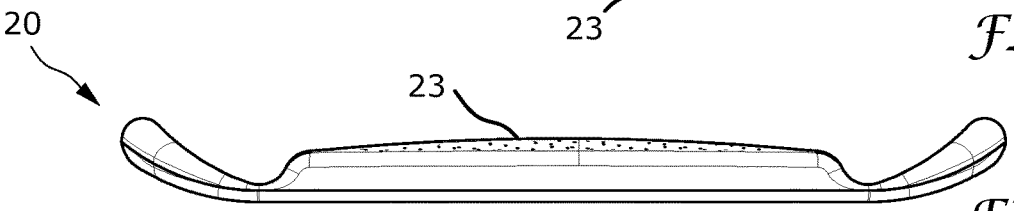
FIG. 17 is a bottom plan view of the FIG. 14 embodiment.
Figure 18:
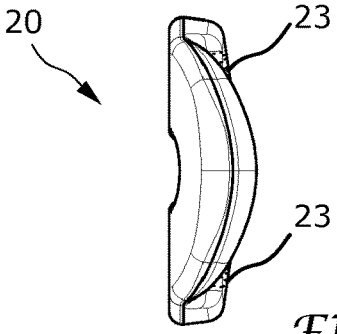
FIG. 18 is a left side elevation view of the FIG. 14 embodiment.
Figure 19:
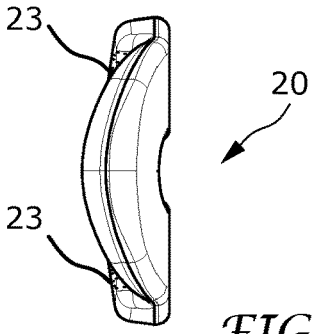
FIG. 19 is a right side elevation view of the FIG. 14 embodiment.
Figure 20:
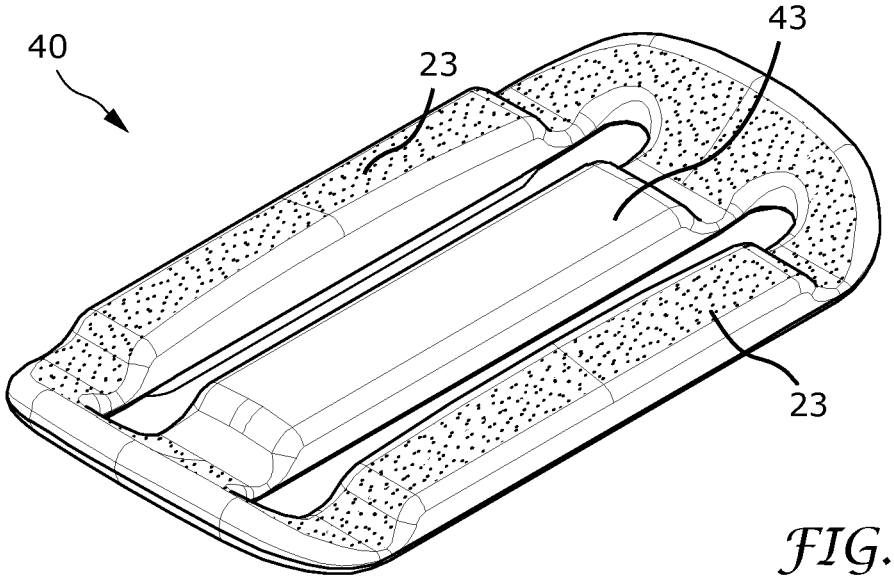
FIG. 20 is a front perspective view of an embodiment of a slide for a strap.
Figure 21:
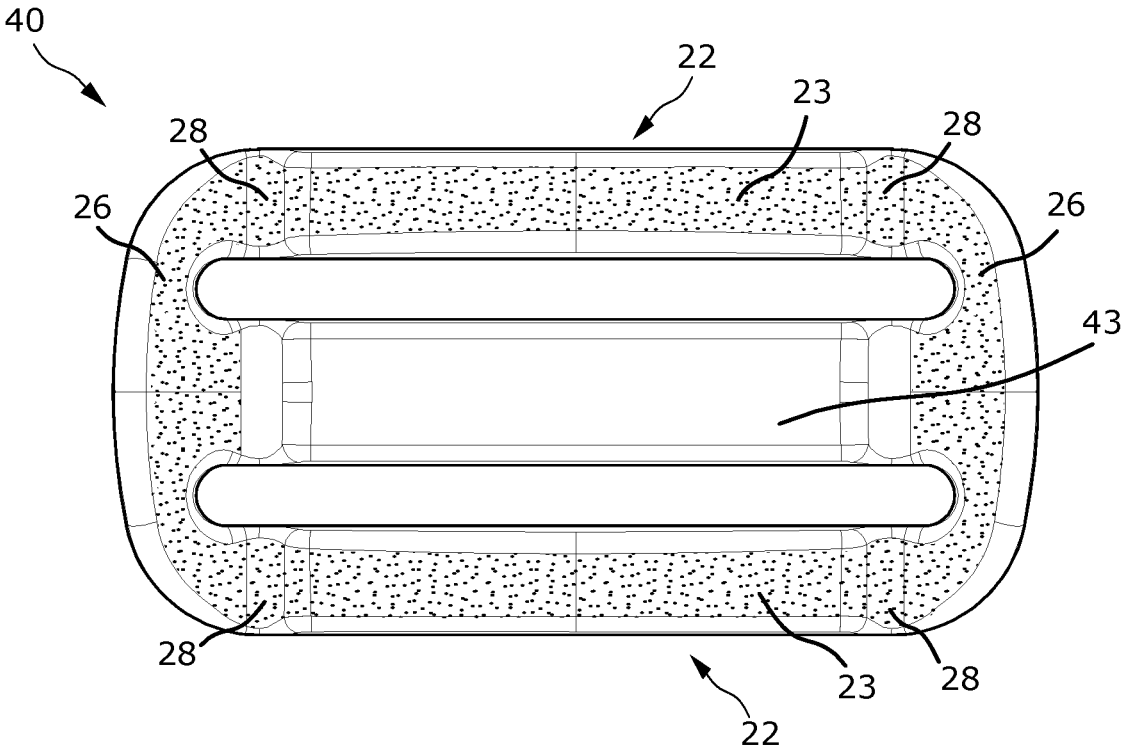
FIG. 21 is a front elevation view of the FIG. 20 embodiment.
Figure 22:
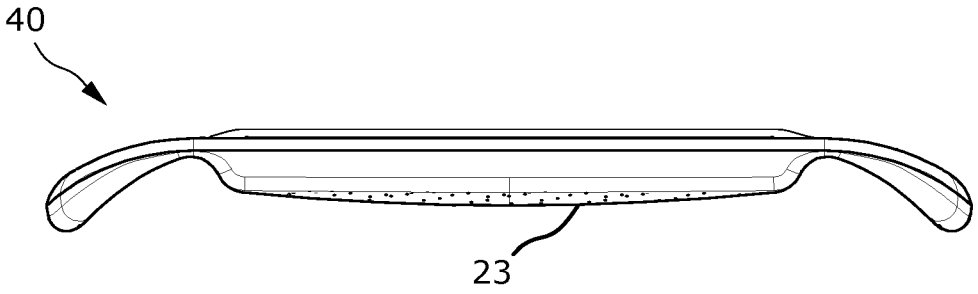
FIG. 22 is a top plan view of the FIG. 20 embodiment.
Figure 23:
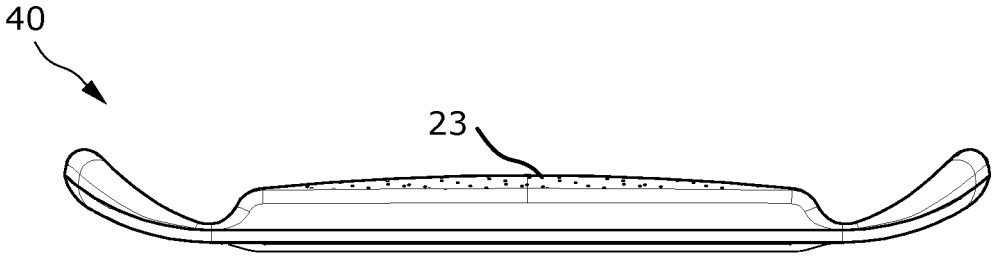
FIG. 23 is a bottom plan view of the FIG. 20 embodiment.
Figure 24:
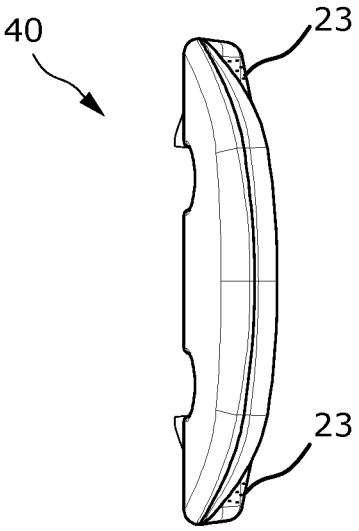
FIG. 24 is a left side elevation view of the FIG. 20 embodiment.
Figure 25:
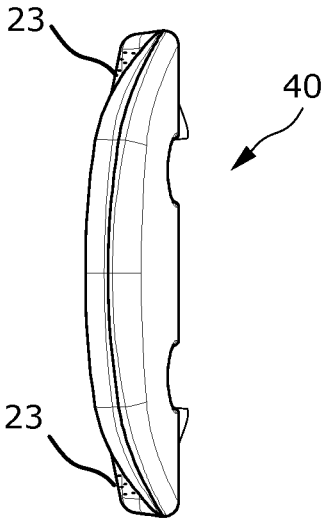
FIG. 25 is a right side elevation view of the FIG. 20 embodiment.

FIG. 12 is a front elevation view of slide 40 with a garment strap 80 (partially shown), and FIGS. 13A & 13B are cross-sectional views along line XIII-XIII of FIG. 12, showing different embodiments of the slide cooperating with garment strap 80. An end 82 of strap 80 is shown in FIG. 13A having been passed through slot 32, over central bar 42, through slot 31, and secured to another portion of strap 80, such as by stitching or welding the strap material together. At region 84, strap 80 is passed through a link or ring connected elsewhere on the garment (not shown) and passed back to the slide at 86. From 86 the strap is fed through slot 32, around the front of bar 42, through slot 31, and out at 88, from which point it may be secured or linked elsewhere on the garment. In FIG. 13B, end 82 of the strap is shown directly connected to central bar 42, such as by welding. This arrangement reduces the overall strap length necessary as compared to the attachment of end 82 in the manner shown in FIG. 13A.

In any of the aforementioned embodiments, longitudinal bars 22 may have an angled edge 34 adjoining slot 30, 31, or 32 (see FIGS. 2, 4, 6, 8 & 9). Angled edges 34 provide resistance against garment 70 or strap 80 unintentionally slipping, especially when the wearer is moving around. FIGS. 11, 13A & 13B show angled edges 34 in contact with garment 70 or strap 80.

FIGS. 14-19 are, respectively, front perspective, front elevation, top and bottom plan, and left and right side views of another embodiment of link 20. In the shown embodiment, the areas of stippling represent regions having a textured surface, while the rest of the surfaces of the link are smooth. In use, the textured or ribbed surface is in contact with the strap material (see, e.g., FIG. 10) and improves grip on the strap, helping maintain the strap in position even in active use such as exercise. In one embodiment, at least a front face 23 of each of longitudinal bars 22 has a textured surface. In other embodiments, forwardmost faces of junctures 28 and transverse bars 26 also have textured surfaces. Textured surfaces may be present on any of the above-described embodiments to improve gripping of the strap.

FIGS. 20-25 are, respectively, front perspective, front elevation, top and bottom plan, and left and right side views of another embodiment of slide 40. In the shown embodiment, the areas of stippling represent regions having a textured surface as described above. In one embodiment, forwardmost faces of one or more of longitudinal bars 22, junctures 28, and transverse bars 26 have textured surfaces for improved grip by the wearer when adjusting the slide. In one embodiment, a front face 43 of the central bar 42 has a smooth surface to permit smooth adjustment of the strap as shown in FIGS. 12 & 13.

Further provided is a garment including a link according to any of the embodiments described above.

The embodiments of the link and garment described herein are exemplary and numerous modifications, combinations, variations, and rearrangements can be readily envisioned to achieve an equivalent result, all of which are intended to be embraced within the scope of the appended claims. Further, nothing in the above-provided discussions of the link and garment should be construed as limiting the invention to a particular embodiment or combination of embodiments. The scope of the invention is defined by the appended claims.

We claim:

1. A link for a garment strap, the link comprising:

a pair of outer mutually parallel longitudinal bars, each having two opposing ends and rear edges lying in a rear plane;

a pair of opposing transverse bars each forming a juncture with an end of each of the longitudinal bars and defining a slot between the longitudinal bars;

wherein the longitudinal bars and the transverse bars have a thickness which tapers to a minimum at the juncture;

wherein, when the garment strap is passed across one of the pair of longitudinal bars and through the slot, the rear plane is oriented toward a body facing side of the garment strap and the transverse bars curve forward from the junctures away from the rear plane; and, wherein the link is formed of a resilient material.

2. The link of claim 1, wherein the thickness at the junctures is at most 50% of a thickness at a midpoint of the longitudinal bars.

3. The link of claim 1, wherein the longitudinal bars have a forwardmost edge lying in a front plane, and the transverse bars curve forward beyond the front plane.

4. The link of claim 1, wherein the longitudinal bars have an angled edge adjoining the slot.

5. The link of claim 1, wherein the link is formed of polyoxymethylene, polyacrylate, polycarbonate, or polyurethene.

6. The link of claim 1, further comprising:

the longitudinal bars having a thickness which tapers to a minimum at the junctures;

the longitudinal bars having an angled edge adjoining the slot; and, wherein the link is formed of polyoxymethylene, polyacrylate, polycarbonate, or polyurethene.

7. The link of claim 1, wherein a front face of each of the longitudinal bars has a textured surface.

8. The link of claim 1, further comprising:

a central bar having two opposing ends, the central bar extending parallel to and spaced between the longitudinal bars; and, the pair of opposing transverse bars each forming a juncture with an end of the central bar and defining respective slots on opposite sides of the central bar.

9. The link of claim 8, wherein the longitudinal bars and the central bar have a thickness which tapers to a minimum at the junctures.

10. The link of claim 9, wherein the thickness at the junctures is at most 50% of a thickness at a midpoint of the longitudinal bars.

11. The link of claim 8, further comprising:

the longitudinal bars and the central bar having a thickness which tapers to a minimum at the junctures;

the longitudinal bars having an angled edge adjoining the slot; and, wherein the link is formed of polyoxymethylene, polyacrylate, polycarbonate, or polyurethene.

12. The link of claim 8, wherein a front face of each of the longitudinal bars has a textured surface and a front face of the central bar has a smooth surface.

13. A garment including a link according to claim 1.

14. A garment including a link according to claim 8.

* * * * *